US008012235B2

(12) United States Patent
Takashima et al.

(10) Patent No.: US 8,012,235 B2
(45) Date of Patent: Sep. 6, 2011

(54) PROCESS FOR PRODUCING LOW-OXYGEN METAL POWDER

(75) Inventors: Hiroshi Takashima, Yasugi (JP); Gang Han, Saitama (JP); Shujiroh Uesaka, Cupertino, CA (US); Tomonori Ueno, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 284 days.

(21) Appl. No.: 12/296,588

(22) PCT Filed: Apr. 14, 2006

(86) PCT No.: PCT/JP2006/307931

§ 371 (c)(1),
(2), (4) Date: Oct. 9, 2008

(87) PCT Pub. No.: WO2007/122684

PCT Pub. Date: Nov. 1, 2007

(65) Prior Publication Data

US 2009/0229412 A1 Sep. 17, 2009

(51) Int. Cl.
*B22F 9/30* (2006.01)

(52) U.S. Cl. ..... 75/346; 148/513

(58) Field of Classification Search ..... None
See application file for complete search history.

(56) References Cited

U.S. PATENT DOCUMENTS

| | | | | |
|---|---|---|---|---|
| 5,736,200 | A * | 4/1998 | Beardsley et al. | 427/450 |
| 6,589,311 | B1 | 7/2003 | Han et al. | |
| 6,676,728 | B2 | 1/2004 | Han et al. | |
| 6,703,106 | B2 * | 3/2004 | Noguchi et al. | 428/844.1 |

FOREIGN PATENT DOCUMENTS

| | | | |
|---|---|---|---|
| JP | 60-224706 | A | 11/1985 |
| JP | 2001-020065 | A | 1/2001 |
| JP | 2002-220601 | A | 8/2002 |
| JP | 2004-091943 | A | 3/2004 |
| JP | 2006-138012 | A | 6/2006 |

* cited by examiner

*Primary Examiner* — George Wyszomierski
(74) *Attorney, Agent, or Firm* — Sughrue Mion, PLLC

(57) ABSTRACT

A process for producing a low-oxygen metal powder, comprising passing a raw metal powder coated by hot melting of a hydrocarbon organic compound through thermal plasma flame composed mainly of an inert gas so as to reduce the content of oxygen in the raw metal powder. Preferably, the obtained metal powder is subjected to heat treatment in vacuum or hydrogen atmosphere. Preferred example of the hydrocarbon organic compound is stearic acid.

4 Claims, 1 Drawing Sheet

PROCESS FOR PRODUCING LOW-OXYGEN METAL POWDER

CROSS REFERENCE TO RELATED APPLICATION:

This is a National Stage of Application No. PCT/JP2006/307931 filed Apr. 14, 2006, the contents of which is incorporated herein by reference in its entirety.

TECHNICAL FIELD

The present invention relates to a process for producing a metal powder.

BACKGROUND ART

Recently, a thin film produced by a sputtering process is widely used in electronic devices such as a semiconductor device, a liquid crystal display, and a magnetic recording device. In the sputtering process, a base material referred to as a target material and a substrate are positioned to face each other in a vacuum vessel, and glow discharge is generated on a surface of the target material while introducing an inert gas, such as Ar, into the vacuum vessel, whereby forming a thin film of an element on the substrate, which element forms the target material.

A target material used as a base material in a sputtering process is required to have a uniform structure and a reduced content of impurities. Oxygen, amongst impurities, is caught in the thin film whereby deteriorating properties thereof. If oxygen is present as an oxide included in a structure of the target material, it is considered that abnormal electric discharge occurs during sputtering, so that an oxygen decrease is strongly desired.

A process of producing a target material is generally classified to be a melting method and a powder sintering method. However, in the case of a target material made of a metal element having a high melting point, it is hard to melt the target material, and also to subject the target material to plastic working in order to homogenize the material structure, so that such a target material has been often produced by the powder sintering method. However, the powder sintering method involves a defect that since powder particles of a powder used in the method have a large specific surface area, a relative amount of oxidized layers formed on the surfaces of the powder particle is high, the target material produced by the powder sintering method is liable to contain a higher amount of oxygen than that produced by the melting method. Especially, in the case where the powder particles have a porous structure, a sponge like structure or a dendritic structure each having a large specific surface area, the above defect is liable to be outstanding.

Accordingly, in general there has been adopted an oxygen decreasing method according to which a powder is subjected to heat treatment in an atmosphere, in which a reducing gas, such as hydrogen, is introduced, whereby reducing the oxidized layers on the powder particles.

Alternatively, the present applicant proposed a new method of decreasing oxygen content in a refractory metal powder, according to which method the refractory metal powder is introduced into thermal plasma flame, in which a hydrogen gas is introduced, whereby refining (i.e. deoxidizing) the refractory metal powder (see JP-A-2001-20065, for example).

DISCLOSURE OF THE INVENTION

Problems to be Solved by the Invention

Even if the aforementioned method of heat treating a powder in an atmosphere, in which a reducing gas, such as hydrogen, is introduced, is effective in decreasing oxygen contained in surfacial oxide layers of powder particles, it will not be always effective to reduce oxygen existing inside the particles. Also in the case of the method disclosed in JP-A-2001-20065, it will not be able to satisfactorily reduce the oxygen content of a lot of the metal powder effectively.

The present invention was made in view of the above problems.

An object of the present invention is to provide a process of producing a low-oxygen metal powder capable of massively and effectively decreasing the oxygen content of a metal powder.

Means for Solving the Problems

The present inventors paid attention to the method of deoxidizing a metal powder with utilization of thermal plasma flame disclosed in JP-A-2001-20065 and found that a reduction effect of the metal powder is improved by coating particles of a raw metal powder with a hydrocarbon organic compound, whereby achieved the present invention.

According to one aspect of the present invention, there is provided a process for producing a low-oxygen metal powder, which comprises causing a raw metal powder to pass through thermal plasma flame a primary component of which is an inert gas whereby reducing the content of oxygen in the raw metal powder, wherein particles of the raw metal powder have been previously coated with a hydrocarbon organic compound which has been provided on the particles in a thermally melted state.

In one embodiment of the present invention, the metal powder having passed through the thermal plasma flame is subject to heat treatment under vacuum.

In another embodiment of the present invention, the metal powder having passed through the thermal plasma flame is subject to heat treatment in a hydrogen atmosphere.

In one embodiment of the present invention, the hydrocarbon organic compound is stearic acid.

Effect of the Invention

According to the producing process of the present invention, since the raw metal powder is efficiently supplied to the thermal plasma flame whereby improving a reduction action, it is possible to efficiently decrease the amount of oxygen in the raw metal powder. Thus, the productivity of a low-oxygen metal powder can be remarkably improved, so that it is possible to very advantageously produce a low-oxygen metal target material by a powder sintering method, for example.

BEST MODE FOR CARRYING OUT THE INVENTION

As stated above, a key feature of the present invention resides in supplying the raw metal powder into thermal plasma flame a primary component of which is an inert gas, wherein particles of the raw metal powder have been previously coated with a hydrocarbon organic compound which has been provided on the particles in a thermally melted state. In the present invention, the inert gas refers to one of gases of atoms in Group 0 which are He, Ne, Ar, Kr, Xe and Rn.

Thermal plasma flame has a high temperature of 5,000 to 20,000K. Thus, in the case where the raw metal powder, particles of which are coated with a hydrocarbon organic compound, is supplied into the thermal plasma flame, the coating hydrocarbon organic compound is instantaneously melted, evaporated, and decomposed to generate carbon atom, hydrogen atom, various ions, excited atoms, neutral nucleus species, etc. The raw metal powder particles also melt to be droplets.

Regarding the standard free energy of an oxide of carbon, which is a primary element of a hydrocarbon organic compound, within the temperature range of the thermal plasma flame, the standard free energy, which is expressed by the equation of "$2C+O_2 \rightarrow 2CO$", is lower than the standard free energies of all other metal oxides as can be seen from the Ellingham diagram. Thus, carbon thermodynamically shows a high reduction effect on oxides. Likewise, hydrogen atom, various ions, excited atoms, neutral nucleus species etc. also contribute to the reduction of oxides. Namely, the thermal plasma flame has a strong reducing atmosphere for oxides therein. Metal powder particles having passed through the thermal plasma flame are recovered as spherical particles having a drastically decreased content of oxygen by reduction of oxides. Here, the additive hydrocarbon organic compound is completely or partially consumed by the reduction reaction and vaporized to be removed.

There might be a technical idea of using a powder mixture of the raw metal powder and a carbon powder, for example, in order to obtain the reduction effect on oxides by carbon as stated above. However, this is not preferable because it is hard to obtain a satisfactory reduction effect in a short time due to a high melting point of 4100° C. of the carbon powder while most of the hydrocarbon organic compounds are decomposed at a temperature of not higher than 400° C.

Reasons why the hydrocarbon organic compound is used in the present invention are because each of carbon and hydrogen as primary components of the hydrocarbon organic compound is an element independently having an oxide reducing effect, and the hydrocarbon organic compound is evaporated and decomposed under the high temperature of the thermal plasma to generate carbon atom, hydrogen atom, various ions, excited atoms, neutral nuclear species, etc. whereby exhibiting a much more excellent oxide reducing effect. Further, the hydrocarbon organic compound has a characteristic that it hardly remains in a low-oxygen metal powder after the thermal plasma treatment.

It should be noted that herein the hydrocarbon organic compound refers to those having long-chain hydrocarbons in the molecular structure, for example, saturated hydrocarbons (alkanes), unsaturated hydrocarbons (alkenes and alkynes), waxes which are solid esters of long-chain alcohols and long chain carboxylic acids, fatty acids, resins, etc., which are solid at room temperature. Further, preferably the hydrocarbon organic compound does not contain other elements than carbon, hydrogen and oxygen in order to restrain interfusion thereof to a low-oxygen metal powder. It is noted that the recited materials may be used individually, or in combination with one another in order to adjust surfacial characteristics or a melting point of the powder.

In the case where a wax or a fatty acid is used as a hydrocarbon organic compound, friction among raw metal powder particles is decreased to improve the fluidity, whereby attaining an effect of increasing a rate of supplying a raw metal powder to the thermal plasma flame in a thermal plasma apparatus used in the invention producing method (to be described below) to improve productivity of a low-oxygen metal powder.

Further, a secondary effect is expectable with use of such a coating of a hydrocarbon organic compound, which is of prevention of loss of the fine metal powder due to evaporation thereof when passing through the thermal plasma flame. The detailed mechanism is, although not accurate, assumed to be influenced by as follows: (1) energy is properly consumed when a hydrocarbon organic compound is evaporated and decomposed under a high temperature of thermal plasma to generate carbon atoms, hydrogen atoms, various ions, excited ions, and neutral nucleus species; and (2) the state of plasma very close to the powder particles changes whereby thermal conduction from the plasma is decreased.

A method of coating raw metal powder particles with a hydrocarbon organic compound comprises, for example, preparing a powder mixture of a hydrocarbon organic compound and a raw metal powder by a known mixer such as a V blender or a rocking mixer, and heating the powder mixture to melt only the hydrocarbon organic compound to coat the raw metal powder particles. Although it is not necessary to coat the entire surface of the respective row metal powder particle, according to the coating method, the hydrocarbon organic compound is dispersed so as to be more uniformly coated on the powder particles as compared with a simply mixed powder of a raw metal powder and a hydrocarbon organic compound, so that the hydrocarbon organic compound can be easily evaporated in the thermal plasma flame whereby enhancing a reduction effect for oxides. Further, taking account of workability when coating the raw metal powder with by heating the hydrocarbon organic compound to melt, and of a disadvantage that the raw metal powder is oxidized in the case where the heating temperature is too high, it is preferable to use a hydrocarbon organic compound having a melting point of not higher than 100° C. Such a hydrocarbon organic compound, may be palmitic acid, stearic acid or paraffin wax, for example. Stearic acid is preferred from the view point of decreasing friction among raw metal powder particles, and of improving the fluidity of the same.

The hydrocarbon organic compound for coating the raw metal powder is used preferably in an amount of 0.05 to 1.00 mass % in regard to a total amount of the raw metal powder and the hydrocarbon organic compound taking account of a residual carbon amount after thermal plasma treatment.

The invention method of producing a low-oxygen metal powder is theoretically applicable to various types of metal powders since the temperature of the thermal plasma flame is higher than melting points of all metals. However, if the method is applied to a powder consisting of a metal element having a low boiling point, there is a risk that the powder is unrecoverably evaporated under the high temperature of the thermal plasma flame. Thus, the method is suitable for powders consisting of metals having a higher melting point than the melting point of Fe (i.e. 1535° C.). In particular, the method is suitable for powder particles each having a porous structure, a cavernous structure or a dendritic structure, and also each having a large surface area.

As described above, the metal powder produced by passing the raw metal powder, each particle of which is coated with a hydrocarbon organic compound, through thermal plasma flame a primary component of which is an inert gas, contains a less oxygen amount than a metal powder produced by a conventional method, whereas if the metal powder is subjected to a heat treatment under vacuum, the metal powder is further reduced to have a less oxygen content. If a heating temperature is too high, the metal powder may be sintered. Thus, it is recommended to conduct the heat treatment at a highest temperature limit without occurrence of sintering. A degree of vacuum in the heat treatment is desirably not higher than 1.0 Pa in order to obtain a satisfactory oxygen decrease effect.

Further, the powder, produced through the thermal plasma flame, can be also subjected to heat treatment in a hydrogen atmosphere, thereby not only being capable of efficiently removing carbon remaining in the metal powder but also making it possible to much more decrease the oxygen content by virtue of a reduction effect by hydrogen. Likewise, since if a heating temperature is too high, the metal powder may be sintered, it is recommended to conduct the heat treatment at a highest temperature limit without occurrence of sintering.

EXAMPLE 1

Figure 1:
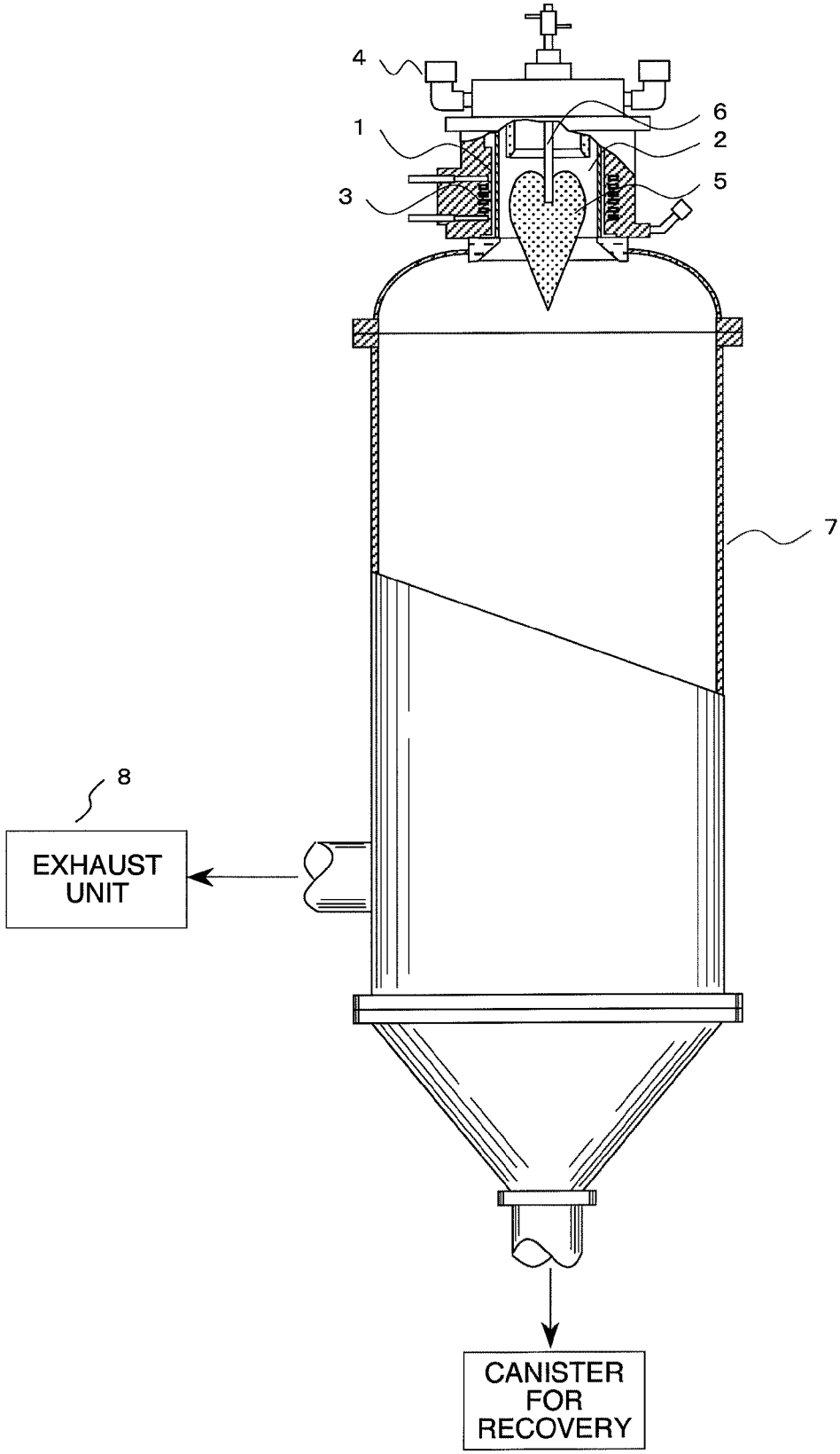
FIG. 1 is a partially sectional side view of one embodiment of a thermal plasma apparatus of the present invention.

In Example 1, there will be described effects of the present invention with regard to a Mo powder.

A thermal plasma apparatus was used in this Example, which apparatus has a configuration shown in FIG. 1. FIG. 1 shows one embodiment of a plasma apparatus according to the present invention. The plasma device shown in FIG. 1 comprises a high-frequency coil 3 disposed outside of a plasma generation space 2 divided by a cooling wall 1, a plasma gas supply unit 4 supplying a plasma gas from an axial one end side of the high-frequency coil 3, a powder supply nozzle 6 supplying a raw powder along with a carrier gas into thermal plasma flame 5 generated within the high-frequency coil, a chamber 7 provided downstream of the plasma flame, and an exhaust unit 8 for exhaustion from the chamber.

The apparatus has the plasma generation space having a cylindrical form of a 100 mm diameter. Operational conditions of plasma were set to be an output of 200 kW and a pressure of 70 kPa with use of an plasma gas consisting of Ar gas of 250 L/min(nor) as an inert gas and $H_2$ gas of 30 L/min(nor), and a carrier gas consisting of Ar of 10 L/min (nor) as an inert gas. A supply rate of a raw metal powder to thermal plasma flame was set to be 20 kg/h.

Table 1 shows a specification of raw materials used in the experiment. The raw materials were those commercially available on the market. Stearic acid having a molecular structure of $CH_3(CH_2)_{16}COOH$, a molecular weight of 284.48, and a melting point of 68 to 71° C., which is one type of fatty acids, was used as a hydrocarbon organic compound. The stearic acid was granular in room temperature and had a larger particle size than the Mo raw powder, so that it was pulverized with utilization of a mortar for use.

TABLE 1

| Material | Specification |
|---|---|
| Mo Raw Powder | Purity: 99.95%, Average Particle Size: 11 μm |
| C Powder | Purity: 99.9%, Average Particle Size: 8 μm |
| Stearic Acid | Granular Form, produced by Wako Pure Chemical Industries, Ltd. |

Table 2 shows specifications of Invention Specimens and Comparative Specimens, and the analysis results of C and O.

In Invention Specimen 1, a Mo raw powder and a stearic acid were weighed, respectively, and mixed with each other for 30 minutes with use of a V blender so that the content of the stearic acid was 0.1 mass %. Then, the mixture was heated in a glass bottle at 80° C. for 30 minutes in the atmosphere to melt the stearic acid, thereby preparing Mo raw powder particles each coated with the stearic acid. The Mo raw powder was caused to pass through thermal plasma flame which had been generated by the thermal plasma apparatus shown in FIG. 1 under the foregoing conditions, thereby conducting the thermal plasma treatment to decrease the oxygen content.

In Comparative Specimen 1, a Mo raw powder was caused to pass through thermal plasma flame under the same conditions as Invention Specimen 1, which Mo raw powder was not coated with a stearic acid, thereby conducting the thermal plasma treatment. In Comparative Specimen 2, a Mo raw powder and a C powder were weighed, respectively, and mixed for 30 minutes with use of a V blender so that the carbon content of the C powder was 0.1 mass %. Then, the mixture was caused to pass through thermal plasma flame under the same conditions as Invention Specimen 1 to conduct thermal plasma treatment.

TABLE 2

| | Specifications of Raw Metal Powder Before Treatment | Heat Treatment | Results of Analysis (mass %) O | C |
|---|---|---|---|---|
| Invention Specimen 1 | Mo Raw Powder + Stearic Acid | no | 0.0161 | 0.0068 |
| Invention Specimen 2 | Mo Raw Powder + Stearic Acid | under vacuum | 0.0082 | 0.0034 |
| Comparative Specimen 1 | Mo Raw Powder (as provided in the Market) | no | 0.0327 | 0.0022 |
| Comparative Specimen 2 | Mo Raw Powder + C Powder | no | 0.0211 | 0.0170 |
| Reference | Mo Raw Powder (as provided in the Market) | — | 0.0530 | 0.0022 |

From Table 2, it will be appreciated that the Mo powder produced in Invention Specimen 1 was remarkably decreased in oxygen as compared with the Mo powder given as the Reference, which had not been subjected to the thermal plasma treatment, and the Mo powders of Comparative Specimens 1 and 2. Further, remaining carbon was remarkably decreased in the Mo powder produced in Invention Specimen 1 than the Mo powder of Comparative Specimen 2. As a result, even if taking account of a balance of low deoxidization and the residual carbon amount, it will be appreciated that the thermal plasma treatment is preferred, in which treatment the raw metal powder particles coated with the melted hydrocarbon organic compound were used.

Invention Specimen 2 was prepared from the Mo powder of Invention Specimen 1. Namely, the Mo powder of Invention Specimen 1 was filled in an alumina crucible paved with a Mo foil, and subjected to a heat treatment at 1,000° C. for 4 hours in a vacuum furnace which was evacuated under control so as to be in a pressure of not higher than $1.0\times10^{-1}$ Pa. As compared with the metal powders only subjected to the thermal plasma treatment, it will be appreciated that the oxygen amount of Invention Specimen 2 was notably decreased so that the residual carbon was also decreased, thereby obtaining a significantly high quality Mo powder.

EXAMPLE 2

In Example 2, there will be described effects of the present invention with regard to a Ru powder.

In this Example, a used apparatus had almost the same basic structure as one in Example 1 except for a cylindrical plasma generation space having a diameter of 70 mm. Operational conditions of plasma were set to be an output of 30 kW and a pressure of 80 kPa with use of an operation gas consisting of Ar gas of 72 L/min(nor) as an inert gas and $H_2$ gas of 10 L/min(nor), and a carrier gas consisting of Ar of 4 L/min(nor) as an inert gas. A supply rate of a raw metal powder to thermal plasma flame was set to be 0.36 kg/h.

Table 3 shows a specification of raw materials used in the experiment. The raw materials were those commercially available on the market. Stearic acid having a molecular structure of $CH_3(CH_2)_{16}COOH$, a molecular weight of 284.48, and a melting point of 68 to 71° C., which is one type of fatty acids, was used as a hydrocarbon organic compound. The stearic acid was granular in room temperature and had a larger particle size than the Ru raw powder, so that it was pulverized with utilization of a mortar for use.

TABLE 3

| Material | Specification |
|---|---|
| Ru Raw Powder | Purity: 99.9%, Average Particle Size: 6 μm |
| Stearic Acid | Granular Form, Produced by Wako Pure Chemical Industries, Ltd. |

Table 4 shows specifications of Invention Specimens and Comparative Specimens, and the analysis results of C and O.

In Invention Specimen 3, a Ru raw powder and a stearic acid each were weighed, respectively, and mixed with each other for 30 minutes with use of a V blender so that the content of the stearic acid was 0.1 mass %. Then, the mixture was heated in a glass bottle at 80° C. for 30 minutes in the atmosphere to melt the stearic acid, thereby preparing Ru raw powder particles each coated with the stearic acid. The Ru raw powder was caused to pass through thermal plasma flame which had been generated by the thermal plasma apparatus under the foregoing conditions, thereby conducting the thermal plasma treatment.

In Comparative Specimen 3, a Ru raw powder was caused to pass through thermal plasma flame under the same conditions as Invention Specimen 3, which Ru raw powder was not coated with a stearic acid, thereby conducting the thermal plasma treatment.

TABLE 4

| | Specifications of Raw Metal Powder Before Treatment | Heat Treatment | Results of Analysis (mass %) O | C |
|---|---|---|---|---|
| Invention Specimen 3 | Ru Raw Powder + Stearic Acid | no | 0.0080 | 0.0113 |
| Invention Specimen 4 | Ru Raw Powder + Stearic Acid | in a Hydrogen Atmosphere | 0.0060 | 0.0030 |
| Invention Specimen 5 | Ru Raw Powder + Stearic Acid | under vacuum | 0.0061 | 0.0065 |
| Comparative Specimen 3 | Ru Raw Powder (as provided in the Market) | no | 0.0095 | 0.0037 |

TABLE 4-continued

| | Specifications of Raw Metal Powder Before Treatment | Heat Treatment | Results of Analysis (mass %) O | C |
|---|---|---|---|---|
| Reference | Ru Raw Powder (as provided in the Market) | — | 0.0510 | 0.0047 |

From Table 4, it will be appreciated that the Ru powder of Invention Specimen 3 was decreased in oxygen as compared with the Ru powder of Reference Specimen, which had not been subjected to thermal plasma treatment, and the Ru powder of Comparative Specimen 3.

Invention Specimen 4 was prepared from the Ru powder of Invention Specimen 3. Namely, the Ru powder of Invention Specimen 3 was filled in an alumina crucible and subjected to a heat treatment at 1,000° C. for 3 hours in a furnace with a hydrogen atmosphere under a set pressure of 105 kPa. It will be appreciated that as compared with Invention Specimen 3 which was subjected to only the thermal plasma treatment, Invention Specimen 4 was decreased much more in the oxygen amount and remarkably in the residual carbon, whereby obtaining a very high quality Ru powder.

Invention Specimen 5 was prepared by filling the Ru powder of Invention Specimen 3 in an alumina crucible, and subjecting to a heat treatment at 1000° C. for 3 hours under vacuum in a vacuum furnace which was evacuated under control so as to be in a pressure of not higher than $1.0\times10^{-1}$ Pa. It will be appreciated that as compared with Invention Specimen 3 which was subjected to only the thermal plasma treatment, Invention Specimen 5 was decreased much more in the oxygen amount and in the residual carbon, whereby obtaining a very high quality Ru powder.

With regard to Invention Specimen 3 and Comparative Specimen 3, weight amounts of the Ru raw powders prior to the thermal plasma treatment and the recovered Ru powders after the thermal plasma treatment were compared. The result is that an evaporation weight loss of Invention Specimen 3 was less, and an amount of the recovered Ru powder after the thermal plasma treatment was increased by 3 wt %. From this, it will be appreciated that it is effective in improvement of a powder production yield to coat Ru raw powder particles with a stearic acid.

INDUSTRIAL APPLICABILITY

A low-oxygen metal powder produced by the present invention method is suitable for a sputtering target material which is produced by a powder sintering method. The sputtering target material is used to form a thin film which is applied in electronic devices such as a semiconductor device, a liquid crystal display, a magnetic recording device, etc.

The invention claimed is:

1. A process for producing a low-oxygen metal powder, which comprises causing a raw metal powder to pass through thermal plasma flame, a primary component of which thermal plasma flame is an inert gas, whereby reducing the content of oxygen in the raw metal powder, wherein particles of the raw metal powder have been previously coated with a hydrocarbon organic compound and is not mixed with carbon powder, which coating has been provided on the particles in a thermally melted state, the hydrocarbon organic compound being solid at room temperature and having a melting point of not higher than 100° C.

2. The process according to claim 1, wherein the metal powder having passed through the thermal plasma flame is subjected to a heat treatment under vacuum to reduce the oxygen content of the metal powder.

3. The process according to claim 1, wherein the metal powder having passed through thermal plasma flame is subjected to a heat treatment in a hydrogen atmosphere to reduce the oxygen content of the metal powder.

4. The process according to claim 1, wherein the hydrocarbon organic compound is stearic acid.

* * * * *